US007352328B2

(12) United States Patent
Moon et al.

(10) Patent No.: US 7,352,328 B2
(45) Date of Patent: Apr. 1, 2008

(54) FLAT-PLATE MIMO ARRAY ANTENNA WITH ISOLATION ELEMENT

(75) Inventors: Young-min Moon, Seoul (KR); Young-eil Kim, Suwon-si (KR); Se-hyun Park, Suwon-si (KR); Kyeong-sik Min, Busan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/441,206

(22) Filed: May 26, 2006

(65) Prior Publication Data

US 2007/0069960 A1 Mar. 29, 2007

(30) Foreign Application Priority Data

Sep. 27, 2005 (KR) ..... 10-2005-0089925

(51) Int. Cl.
*H01Q 1/38* (2006.01)
*H01Q 21/00* (2006.01)
*H01Q 1/52* (2006.01)

(52) U.S. Cl. ..... 343/700 MS; 343/817; 343/841

(58) Field of Classification Search ..... 343/700 MS, 343/841, 844, 853, 817, 818
See application file for complete search history.

(56) References Cited

U.S. PATENT DOCUMENTS

| | | | | |
|---|---|---|---|---|
| 6,069,586 | A * | 5/2000 | Karlsson et al. | 343/700 MS |
| 6,069,588 | A | 5/2000 | Karisson et al. | |
| 6,218,989 | B1 * | 4/2001 | Schneider et al. | 343/700 MS |
| 6,473,040 | B1 | 10/2002 | Nakamura | |
| 6,515,634 | B2 * | 2/2003 | Desclos et al. | 343/818 |

FOREIGN PATENT DOCUMENTS

| | | | |
|---|---|---|---|
| EP | 0720252 | B1 | 7/1996 |
| EP | 0847101 | A2 | 6/1998 |
| FR | 2616015 | A1 | 12/1988 |
| GB | 2390225 | A | 12/2003 |
| JP | 2005-124056 | A | 5/2005 |
| WO | 2004/017462 | A1 | 2/2004 |

* cited by examiner

*Primary Examiner*—Shih-Chao Chen
(74) *Attorney, Agent, or Firm*—Sughrue Mion, PLLC

(57) ABSTRACT

A flat-plate MIMO array antenna includes a substrate, a plurality of antenna elements disposed on the substrate, and at least one isolation element interposed between a plurality of antenna elements on the substrate and connected to a ground. Mutual interference between the antenna elements is prevented by the isolation element formed between the antenna elements, thereby preventing the distortion of the radiation pattern. Also, since the isolation element is grounded to the ground surface, the isolation element operates as a parasitic antenna, thereby increasing the output gain.

20 Claims, 8 Drawing Sheets

FLAT-PLATE MIMO ARRAY ANTENNA WITH ISOLATION ELEMENT

This application claims priority from Korean Patent Application No. 10-2005-0089925, filed on Sep. 27, 2005, the entire content of which is incorporated herein by reference.

BACKGROUND OF THE INVENTION

1. Field of the Invention

Apparatuses and methods consistent with the present invention relate to a flat-plate multiple input and multiple output (MIMO) array antenna, and more particularly, to a flat-plate MIMO array antenna that is formed on a substrate in a shape of a flat plate and has an isolation element for preventing interference between antenna elements.

2. Description of the Related Art

An antenna is a component for converting an electric signal into a specified electromagnetic wave to radiate the wave into a free space and vice versa. An effective area in which the antenna radiates or detects the electromagnetic wave is generally referred to as a radiation pattern. A plurality of antenna elements may be arranged in a specific structure to combine radiation pattern and radiation power of each antenna. Accordingly, the overall radiation patterns can be formed to have a sharp shape, and the electromagnetic wave of the antenna can spread out farther. The antenna having such a structure is referred to as an array antenna. The array antenna is used in a MIMO system for implementing multiple input/output operations.

FIG. 1 is a view illustrating an example of a related art flat-plate MIMO array antenna.

The related flat-plate MIMO array antenna shown in FIG. 1 is a 2-channel flat-plate array antenna having two antenna elements 11 and 12 and two feed units 21 and 22. The two antenna elements 11 and 12 are arranged at a half-wave ($\lambda/2$) spacing on a substrate 10.

FIG. 2 is a view depicting an S-parameter characteristic to a frequency of the related art flat-plate MIMO array antenna in FIG. 1. In FIG. 2, $S_{11}$ indicates an S-parameter that is an input reflection coefficient of the first antenna element 11, and $S_{21}$ indicates an S-parameter that is a mutual coupling of two antenna elements 11 and 12. It will be understood that in the bands of 5.25 GHz and 5.8 GHz, $S_{21}$ has a value in the range from about −18 dB to about −20 dB.

Since a plurality of antenna elements are used, a problem occurs wherein the mutual coupling resulting from interference between the antenna elements distorts the radiation pattern of the antenna. Accordingly, diverse methods are needed for suppressing the mutual coupling for the related art flat-plate MIMO array antenna.

One such measure for preventing the mutual coupling between the antenna elements in the related art flat-plate MIMO array antenna, involves stacking a 3-dimensional electrical wall between the antenna elements arranged on the substrate, such that a phase difference between the antenna elements becomes 180 degrees or an electrical distance becomes a half wavelength. Accordingly, since the mutual coupling of the antenna elements is suppressed, propagation of the electromagnetic wave radiated from each antenna to other antennas is minimized.

However, since the related art method employs the 3-dimensional configuration, the overall volume of the antenna chip is increased, so that it is difficult to use the antenna in a micro electronic device. Further, there are other drawbacks in that the manufacture itself is difficult, and the integration of the manufactured product is also difficult, causing manufacturing cost to increase significantly.

SUMMARY OF THE INVENTION

An aspect of the present invention is to provide a flat-plate MIMO array antenna having a plurality of antenna elements disposed on a substrate in a shape of a flat-plate, in which interference of the antenna elements is prevented by offsetting electromagnetic waves radiated from a plurality of the antenna elements and propagated to other antennas, and distortion of a radiation pattern is prevented with its output gain increased.

Another aspect of the present invention is to provide a flat-plate MIMO array antenna which can be easily manufactured in a compact size.

The foregoing and other aspects are realized by providing a flat-plate MIMO array antenna, according to the present invention, which comprises a substrate, a plurality of antenna elements disposed on the substrate, and at least one isolation element interposed among a plurality of the antenna elements on the substrate and connected to a ground.

At least one of the isolation elements may cancel an influence in which an electromagnetic wave radiated from each antenna element affects other antenna elements.

The isolation element may be grounded through a via hole.

The flat-plate MIMO array antenna may further include a plurality of feed units for feeding a power to the plurality of the antenna elements.

The plurality of antenna elements may include a first antenna element disposed on the substrate, and a second antenna element spaced apart from the first antenna element by a predetermined distance on the substrate.

The isolation element may be interposed between the first and second antenna elements, and the isolation element may be spaced apart from the first and second antenna elements by a predetermined distance.

The first and second antenna elements may be symmetrically disposed with respect to a predetermined virtual line of the substrate, and the isolation element may be symmetrically disposed with respect to the predetermined virtual line.

The isolation element may be formed in an inverted U-shape, and the isolation element may have a length of $\lambda$ which is a wavelength of the wave radiated from the first and second antenna elements.

The first and second antenna elements may be spaced apart from each other by a distance of $\lambda/2$, and the isolation element may be spaced apart from the first and second antenna elements by a distance of $\lambda/4$.

The isolation element may include first and third strips disposed in parallel with respect to the line, and a second strip for connecting one end of the first strip and one and of the third strip.

Each of the first and second strips may have a length of about $0.39\lambda$, and the third strip may have a length of about $0.17\lambda$, and the isolation element may have a width of about $0.026\lambda$, in which $\lambda$ is a wavelength of the wave radiated from the first and second antenna elements.

The ground may be disposed on a side of the substrate opposite to one side of the substrate on which the plurality of the antenna elements are disposed.

BRIEF DESCRIPTION OF THE DRAWINGS

The above aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
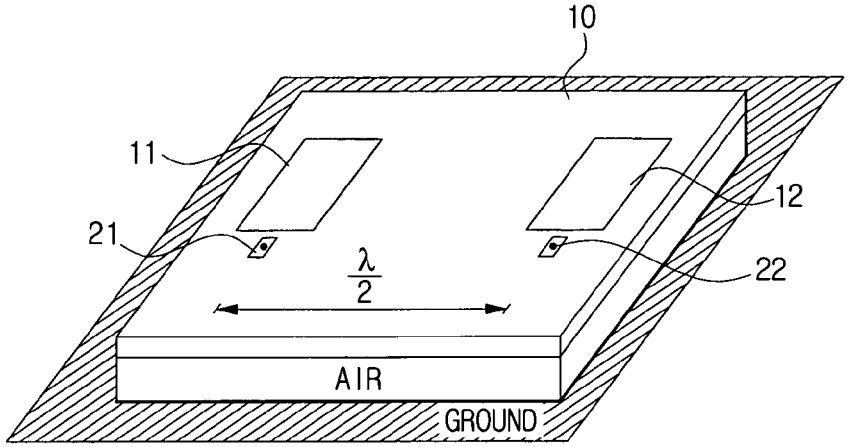
FIG. 1 (RELATED ART)
FIG. 1 is a view illustrating an example of a related art flat-plate MIMO array antenna.
Figure 2:
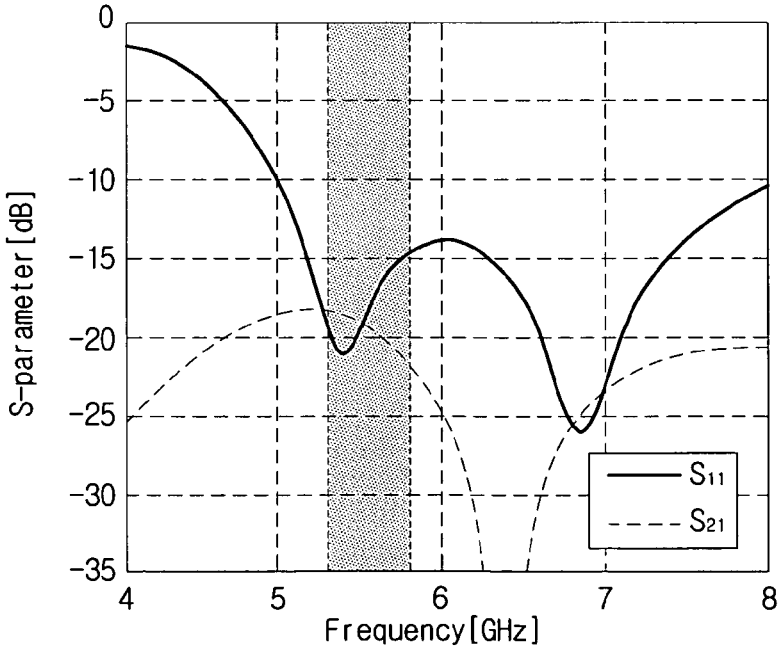
FIG. 2 (RELATED ART)
FIG. 2 is a view depicting an S-parameter characteristic to a frequency of the related art flat-plate MIMO array antenna in FIG. 1.

Certain exemplary embodiments of the present invention will be described in greater detail with reference to the accompanying drawings.

In the following description, the same drawing reference numerals are used for the same elements throughout the drawings. The matters defined in the description such as a detailed construction and elements are only provided to assist understanding of the invention. However, the present invention can be realized in manners different from those disclosed herein. Also, well-known functions or constructions are not described in detail since they would obscure the invention in unnecessary detail.

Figure 3:
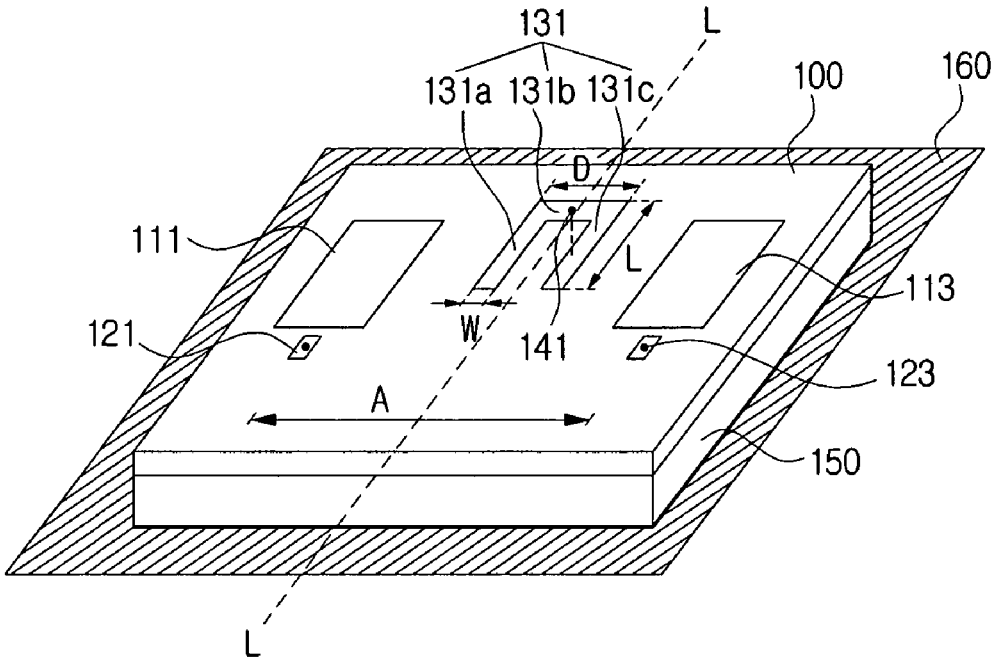
FIG. 3 is a view illustrating a MIMO array antenna according to an exemplary embodiment of the present invention.

FIG. 3 is a view illustrating a MIMO array antenna according to an exemplary embodiment of the present invention, in which a 2-channel flat-plate array antenna has an isolation element according to the present invention.

The MIMO array antenna in FIG. 3 includes first and second antenna elements 111 and 113 disposed on a substrate 100 in shape of a flat-plate, an isolation element 131, and two feed units 121 and 123.

The substrate 100 may be a printed circuit board. Accordingly, by removing a metal film from a surface of the PCB in a predetermined pattern, the first and second antenna elements 111 and 113 and the isolation element 131 may be disposed on the substrate 100 at one time. Since additional material is not necessarily layered on the substrate 100 and the thin metal film forms the first and second antenna elements 111 and 113 and the isolation element 130, the antenna may be embodied in a flat-plate of the closest proximity to a 2-dimensional structure. Accordingly, the volume of the antenna can be minimized.

The first and second antenna elements 111 and 113 are supplied with a specified high-frequency signal from the feed units 121 and 123, respectively, to radiate electromagnetic waves. The first and second antenna elements 111 and 113 may be symmetrically disposed on the substrate 100 with respect to a line L-L'. Preferably, but not necessarily, a distance A between center points of the first and second antenna elements 111 and 113 is set as $\lambda/2$, wherein $\lambda$ is a wavelength of the signal to be output from the antenna.

The two feed units 121 and 123 are to supply a high-frequency signal to the first and second antenna devices 111 and 113. In FIG. 3, the feed units 121 and 123 are formed to be spaced apart from lower portions of the first and second antenna elements 111 and 113 at a predetermined distance, respectively. The feed units 121 and 123 are connected to the lower portion of the substrate 100 to receive a high-frequency signal from the exterior, respectively. The electromagnetic energy supplied to the feed units 121 and 123 in the form of high-frequency signal is transferred to the first and second antenna elements 111 and 113. Accordingly, the first and second antenna elements 111 and 113 radiate the electromagnetic waves.

The isolation element 131 may be disposed between the first and second antenna elements 111 and 113, and is connected to a ground surface 160 through a via hole 141. In particular, the isolation element 131 is disposed so that it is positioned on a center between the first and second antenna elements 111 and 113. Preferably, but not necessarily, the spacing between the isolation element 131 and the first and second antenna elements 111 and 113 is set as $\lambda/4$. Preferably, but not necessarily, an overall length of the isolation element 131 is $\lambda$. Further, the isolation element may be symmetrically formed on the substrate 100 with respect to the line L-L', and may be fabricated in an inverted U-shaped form. The isolation element 131 may be divided into a first strip 131*a*, a second strip 131*b*, and a third strip 131*c*. The first and second strips are formed in parallel to each other with respect to the line L-L', and the second strip 131*b* may be formed to connect to one end of the first strip 131*a* and one end of the third strip 131*c*.

In the exemplary embodiment, an air gap 150 is formed between the substrate 100 and the ground surface 160, but it is not limited thereto. Alternatively, dielectrics may be inserted into a space around the air gap, or the ground surface 160 may be adhered directly to the substrate 100.

Figure 4A:
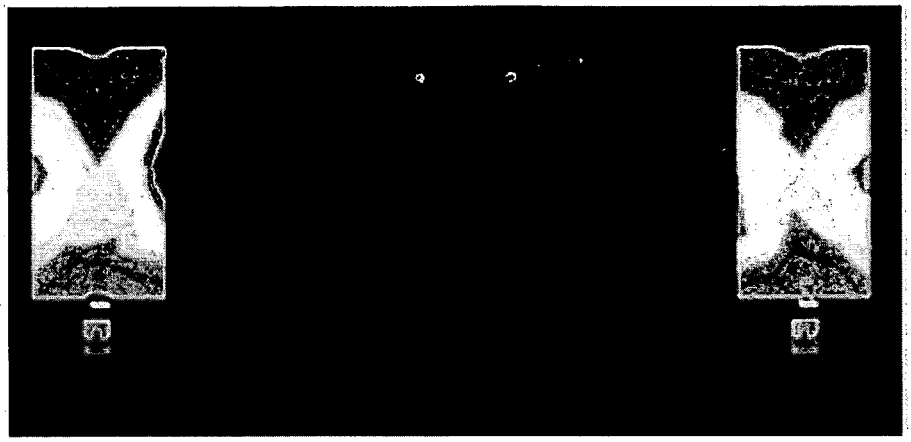
FIGS. 4A through 4C are views explaining the operation characteristic of an isolation element in the MIMO array antenna in FIG. 3.
Figure 4B:
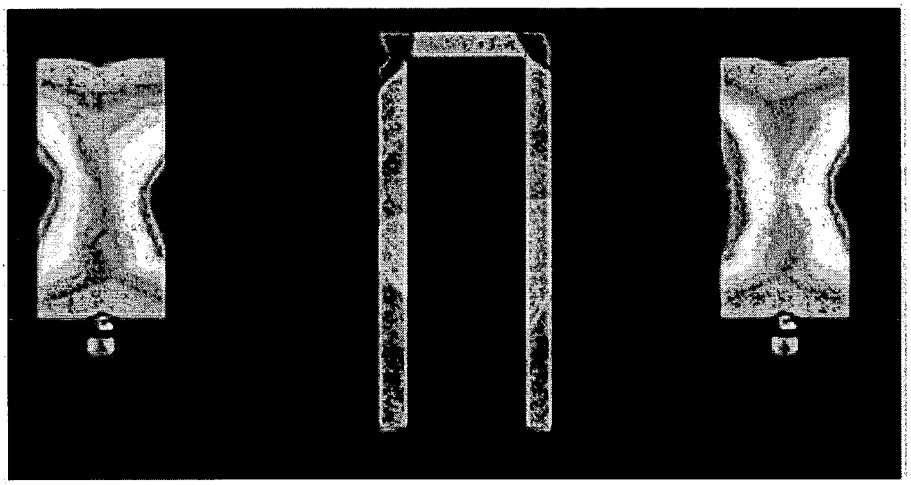
Figure 4C:
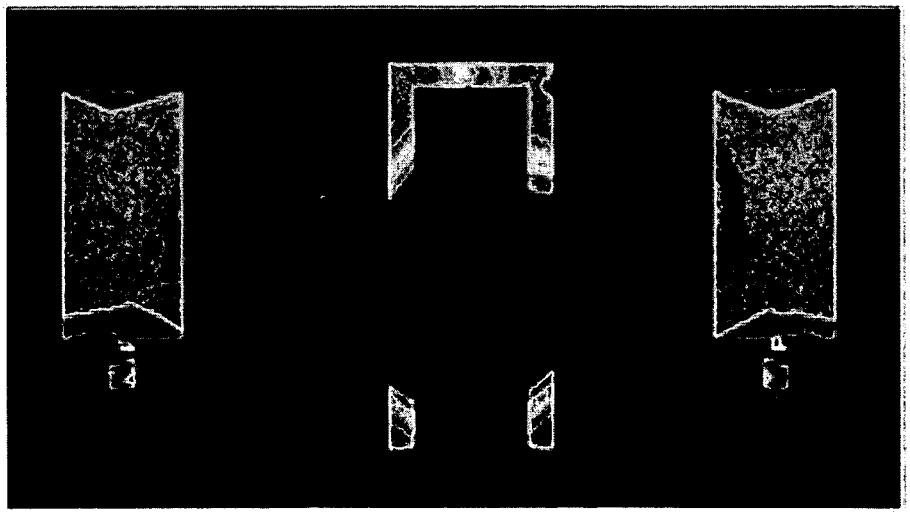

The operation characteristics of the isolation element 131 in the MIMO array antenna according to the present invention will now be described with reference to FIGS. 4A through 4C. FIG. 4A shows the current distribution in the case where a high frequency is simultaneously applied to two antenna elements 11 and 12 of the related art flat-plate MIMO array antenna shown in FIG. 1, while FIG. 4B shows the current distribution in the case where a high frequency is simultaneously applied to two antenna elements 111 and 113 of the flat-plate MIMO array antenna shown in FIG. 3. FIG. 4C shows the current distribution of an inverted phase relative to that in FIG. 4B.

As shown in FIG. 4A, if two antenna elements 11 and 12 are simultaneously applied with the high frequency, the current distribution of the two antenna elements 11 and 12 are identically represented. The mutual coupling of two antenna elements due to an unwanted horizontally polarized wave is provided at −18 dB and −21 dB in a band of 5.25 GHz and 5.8 GHz, respectively. Accordingly, the mutual coupling has a large value.

As shown in FIG. 4B, if the isolation element 131 is disposed between two antenna elements 111 and 113, an unwanted horizontally polarized wave generated between two antenna devices 111 and 113 is offset by the isolation element 131, as can be seen from the current distribution. Since the spacing between the isolation element 131 and the first and second antenna elements 111 and 113 is set as $\lambda/4$, the incident wave and the reflected wave have a phase difference of 90° to each other for the isolation element 131, which permits the waves to be offset. The interfering component induced by the isolation element 131 is absorbed and eliminated by the ground surface 160 through the via hole 141.

FIG. 4C shows that the current is robustly distributed in the isolation element 131 if there is the current distribution of an inverted phase relative to that of FIG. 4B. This phenomenon means that the isolation element 131 of the present invention operates as an antenna. In other words, the isolation element 131 suppresses the mutual coupling of two antenna elements 111 and 113, and also serves as a parasitic antenna, thereby improving the gain of the antenna.

Figure 5A:
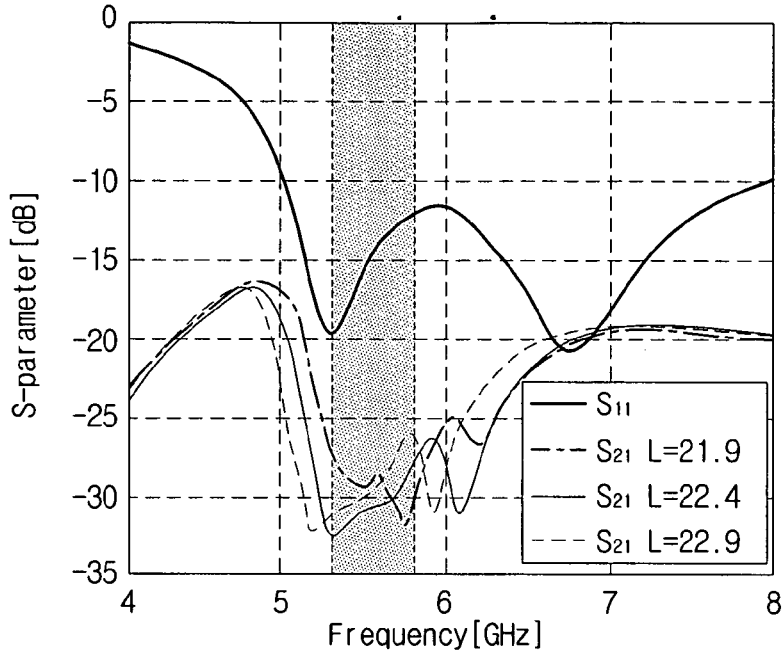
FIGS. 5A through 5D are views explaining a variation of an S-parameter characteristic to a frequency according to a parameter variation of an isolation element and an optimum parameter of the isolation element.

The variation of the S-parameter characteristic to the frequency according to a parameter variation of the isolation element in the antenna according to the present invention will now be described. FIG. 5A shows the S-parameter characteristic to the frequency according to a length L of the first and third strips 131*a* and 131*c* of the isolation element 131. In the case where the flat-plate MIMO array antenna shown in FIG. 1 is fabricated such that a distance between the center points of the first and second antenna devices 111 and 113 is about 0.525λ (30 mm), a length D of the second strip 131*b* of the isolation element 131 is about 0.17λ (9.5 mm), and a width W of the isolation element 131 is about 0.026λ (1.5 mm), FIG. 5A is a graph depicting the S-parameter characteristic to the frequency measured when the length L of the first and third strips 131*a* and 131*c* of the isolation element 131 is varied. Herein, λ is a wavelength of the signal output from the antenna, and numerals in parentheses are values when a frequency band of the signal is about 5 GHz, which are identically applied to the following examples.

It will be understood from FIG. 5A that an S-parameter, $S_{11}$, meaning an input reflection coefficient of the first antenna element 111 has a value of up to −10 dB at bands from 5 GHz to 8 GHz, and is constantly maintained, regardless of a variation of the length L of the first and third strips 131*a* and 131*c*.

Meanwhile, it will be understood that a resonance frequency of an S-parameter, $S_{21}$, meaning the mutual coupling of the first and second antenna elements 111 and 113 is lowered as the length L is increased. It indicates that a suppressing band of the mutual coupling can be adjusted by properly regulating the length L according to the demand of a user, while $S_{11}$, is constantly maintained. In particular, it is noted that in bands from 5.15 GHz to 5.25 GHz and from 5.75 GHz to 5.85 GHz required by IEEE 802.11a, the mutual coupling can be suppressed when the length L is 0.39λ (22.4 mm).

Figure 5B:
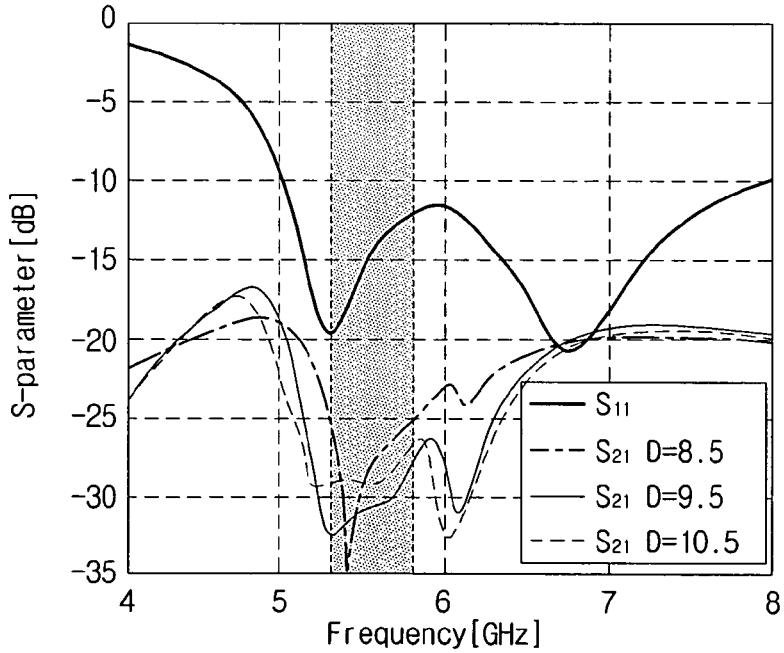

FIG. 5B shows the S-parameter characteristic to the frequency according to a length D of the second strip 131*b* of the isolation element 131. In the case where a length L of the first and third strips 131*a* and 131*c* is about 0.39λ (22.4 mm), a width W of the isolation element 131 is about 0.026λ (1.5 mm), and other conditions are set in the same manner as those of FIG. 5A, FIG. 5B is a graph depicting the S-parameter characteristic to the frequency measured when the length D of the second strip 131*b* is varied.

It will be understood from FIG. 5B that $S_{11}$ has a value of up to −10 dB at bands from 5 GHz to 8 GHz, and is constantly maintained, regardless of the variation of the length D of the second strip 131*b*. Meanwhile, it will be noted that the length D of the second strip 131*b* affects the resonance frequency and resonance of $S_{21}$, and if the length D is 0.17λ (9.5 mm) in the band of 5 GHz, $S_{21}$ has the maximum value.

Figure 5C:
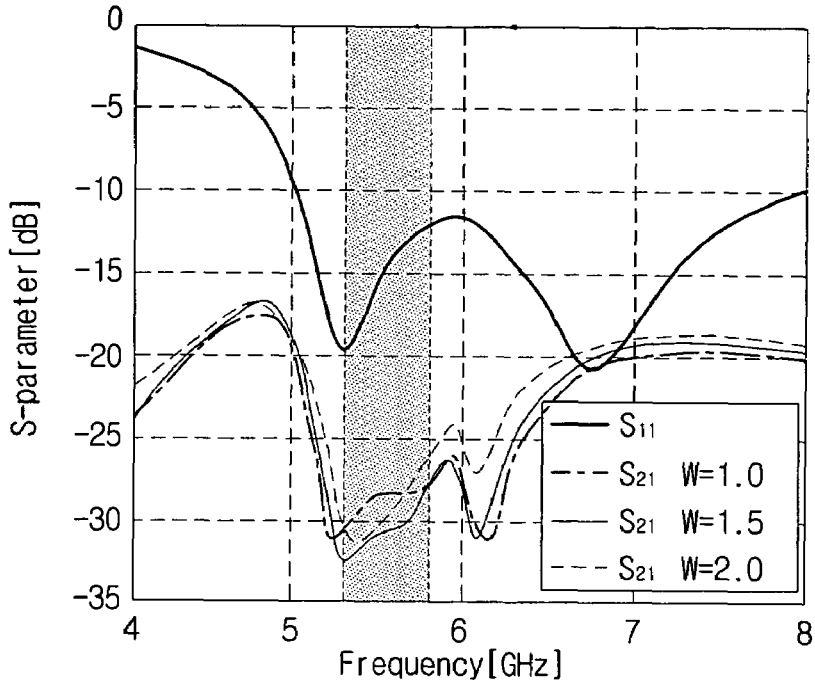

FIG. 5C shows the S-parameter characteristic to the frequency according to the width W of the isolation element 131. In the case where a length L of the first and third strips 131*a* and 131*c* is about 0.39λ (22.4 mm), a length of the second strip 131*b* is 0.17λ (9.5 mm), and other conditions are set in the same manner as those of FIG. 5A, FIG. 5B is a graph depicting the S-parameter characteristic to the frequency measured when the width W is varied.

It will be understood from FIG. 5C that $S_{11}$ has a value of up to −10 dB at bands from 5 GHz to 8 GHz, and is constantly maintained, regardless of a variation of the width W. Meanwhile, it will be noted that since the isolation element 131 has high impedance according to the width W, as shown in FIG. 5C, the width W of the isolation element 131 affects the resonance of $S_{21}$, and if the width W is 0.026λ (1.5 mm) in the band of 5 GHz, $S_{21}$ has the maximum value.

Figure 5D:
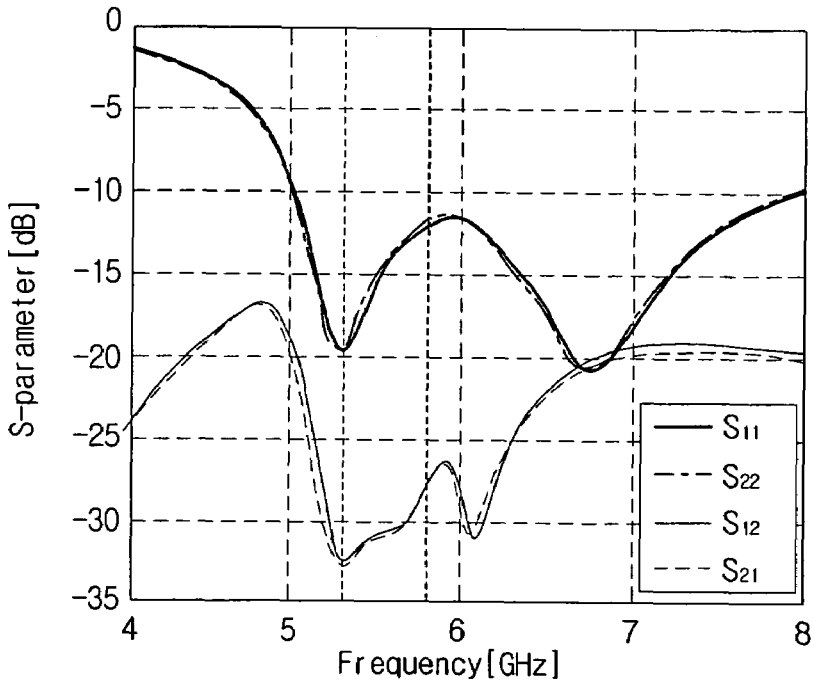

As shown in FIGS. 5A through 5C, the optimum parameters of the isolation element 131 has a length L of 0.39λ (22.4 mm), a length D of 0.17λ (9.5 mm), and a width W of 0.026λ (1.5 mm). FIG. 5D shows the S-parameter characteristic to the frequency of the MIMO array antenna according to the present invention fabricated by applying the optimum parameters to the isolation element 131.

It will be understood from FIG. 5D that the reflection coefficient $S_{11}$, of the first antenna element 111 and the reflection coefficient $S_{21}$ of the second antenna element 113 satisfy the bands from 5.15 GHz to 5.25 GHz and from 5.75 GHz to 5.85 GHz required by IEEE 802.11a, and have a good characteristic of up to −33 dB and −28 dB at the bands of 5.25 GHz and 5.8 GHz.

Figure 6:
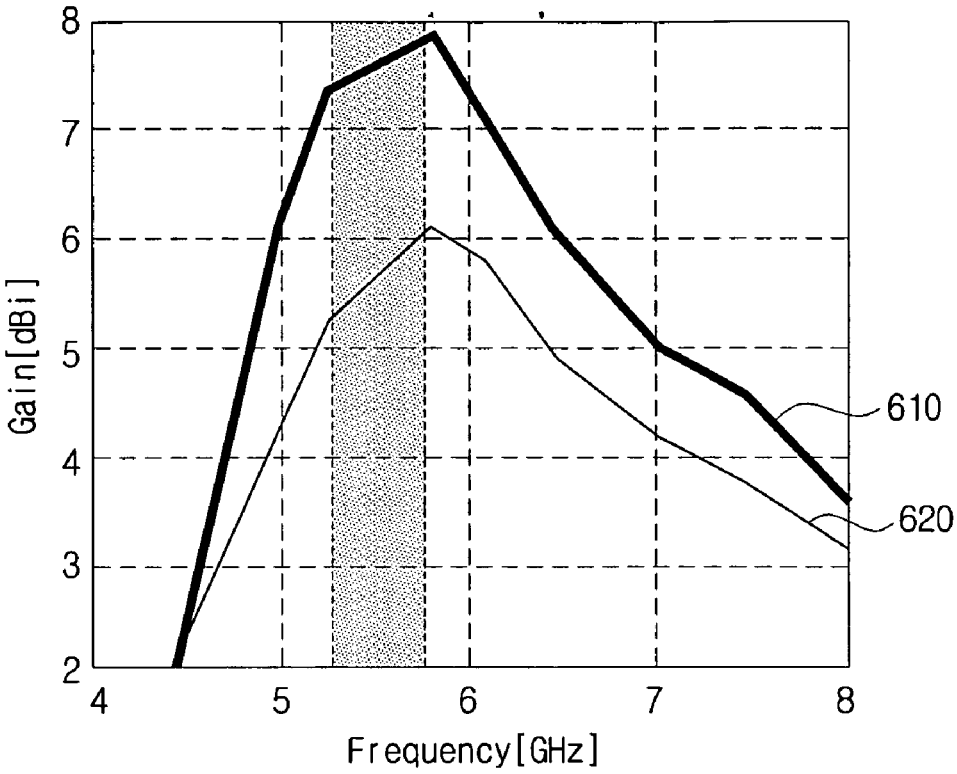
FIG. 6 is a view depicting a gain characteristic of a MIMO array antenna according to the present invention in comparison with a related art MIMO array antenna.

FIG. 6 is a view depicting a gain characteristic of the MIMO array antenna according to the present invention in comparison with a related art MIMO array antenna.

In FIG. 6, a curve 610 indicates the gain of the MIMO array antenna according to the present invention, whereas a curve 620 indicates the gain of a related art MIMO array antenna. As shown in FIG. 6, it will be understood that the gain of the MIMO array antenna according to the present invention is wholly improved to about 2 dBi, compared as that of the related art MIMO array antenna. This is resulted from that the isolation element 131 operates as a parasitic antenna, which improves the gain of the antenna.

Figure 7A:
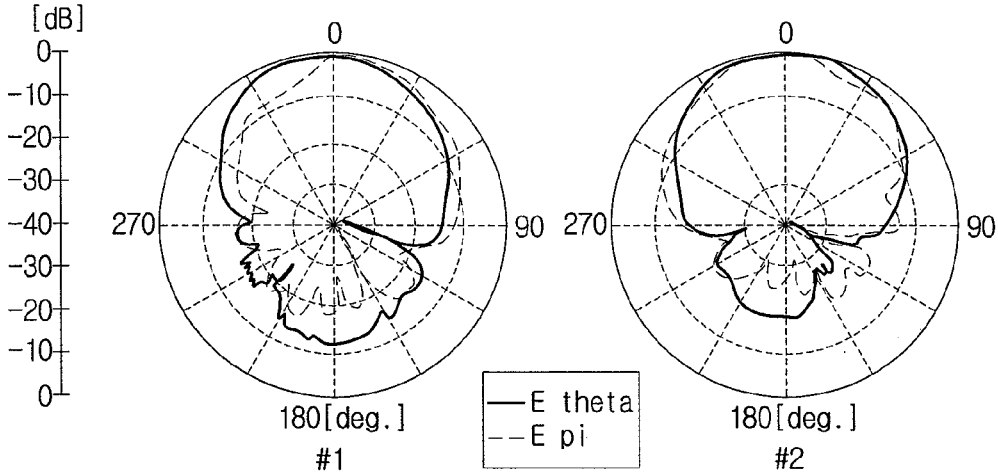
FIGS. 7A and 7B are views depicting a radiation pattern of the flat-plate MIMO array antenna in FIG. 3 in the bands of 5.25 GHz and 5.8 GHz.
Figure 7B:
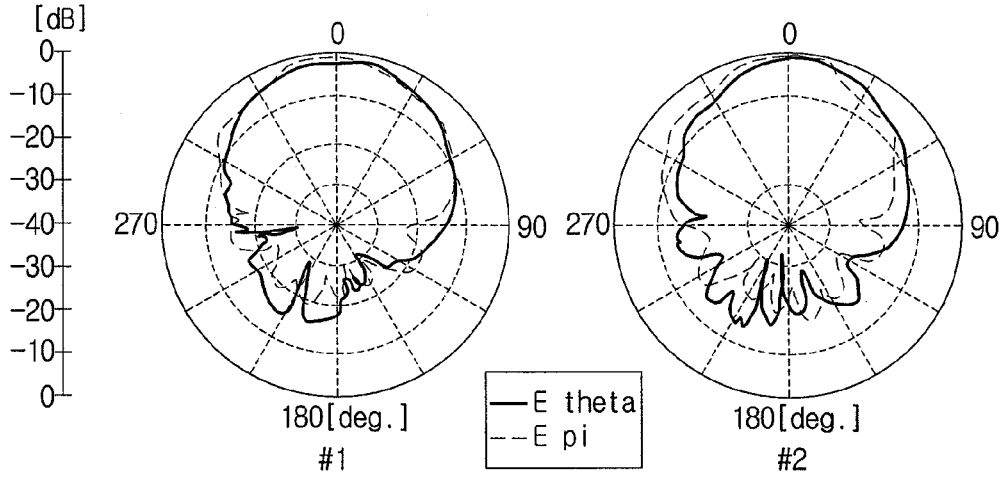

FIG. 7A is a view depicting a radiation pattern of the flat-plate MIMO array antenna in FIG. 3 at a band of 5.25 GHz, and FIG. 7B is a view depicting a radiation pattern of the flat-plate MIMO array antenna in FIG. 3 at a band of 5.8 GHz. In FIGS. 7A and 7B, graphs No. 1 and No. 2 show the radiation pattern of the first and second antenna elements 111 and 113 at bands of 5.25 GHz and 5.8 GHz, respectively. Referring to FIGS. 7A and 7B, it will be understood that the flat-plate MIMO array antenna shown in FIG. 3 shows slight distortion due to the effect of the isolation element, but the proper radiation pattern is suitable to apply it to an actual radio communication environment.

FIG. 3 shows the MIMO array antenna having two antenna elements and one isolation element. Alternatively, two or more antenna elements may be provided, and at least one isolation element may be formed between each antenna element.

Figure 8:
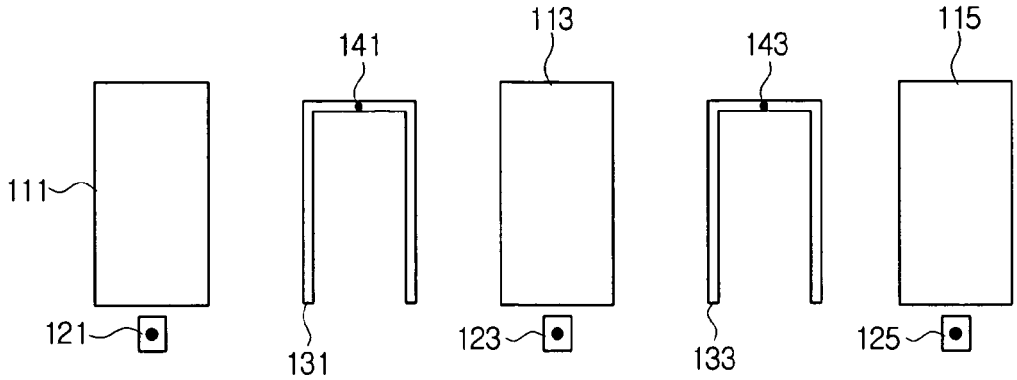
FIG. 8 is a view illustrating a MIMO array antenna according to another exemplary embodiment of the present invention.

FIG. 8 is a view illustrating the construction of a MIMO array antenna according to another exemplary embodiment of the present invention. The MIMO array antenna includes first through third antenna elements 111, 113, and 115 formed on a substrate (not shown) in shape of a flat-plate, first and second isolation elements 131 and 133, and three feed units 121, 123, and 125.

The first and second isolation elements 111 and 113, two feed units 121 and 123, and the first isolation element 131 may be fabricated in the same way as those of the MIMO array antenna in FIG. 3. The third antenna element 115, the feed unit 125, and the second isolation element 133 may be fabricated symmetrically with the first antenna device 111, the feed unit 121, and the first isolation element 131 with respect to the second antenna element 113.

The unwanted horizontally polarized wave generated between three antenna elements 111, 113, and 115 is offset by the first and second isolation elements 131 and 133, and the interfering component induced by the first and second isolation elements 131 and 133 is absorbed and eliminated by the ground surface (not shown) through via holes 141 and 143.

Figure 9:
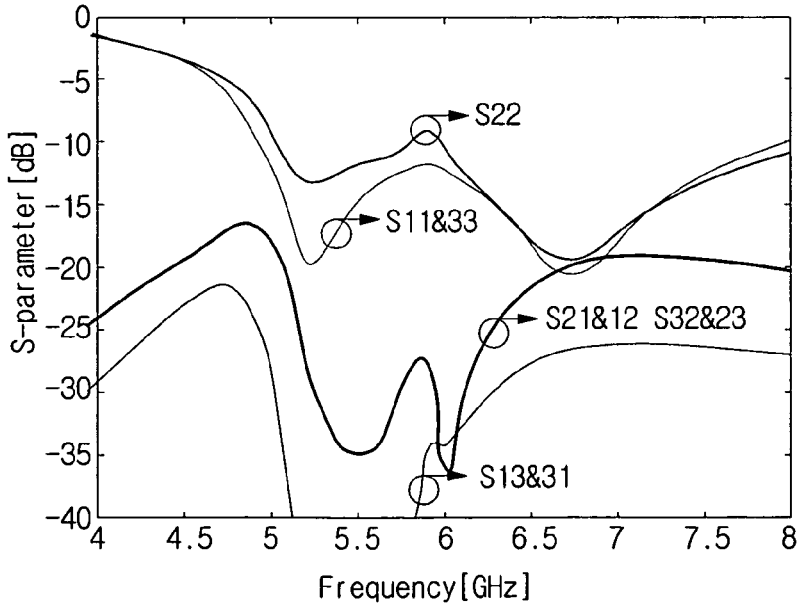
FIG. 9 is a view depicting an S-parameter characteristic to a frequency of the MIMO array antenna in FIG. 8.

FIG. 9 is a view depicting an S-parameter characteristic to a frequency of the MIMO array antenna in FIG. 8. FIG. 9 is a graph depicting the S-parameter characteristic to the frequency measured in the case where distances between center points of the first and second antenna devices 111 and 113 and the second and third antenna devices 113 and 115 in the flat-plate MIMO array antenna of FIG. 8 are set as about 0.525λ (30 mm), respectively, and the first and second isolation elements 131 and 133 are fabricated according to the optimum parameters applied to the isolation element in FIG. 5D.

As shown in FIG. 9, it will be understood that since reflection coefficients of the first, second, and third antenna elements 111, 113, and 115 have a value of up to −10 dB at a band of 5 GHz, it may be used in bands from 5.15 GHz to 5.25 GHz and from 5.75 GHz to 5.85 GHz required by IEEE 802.11a. Also, mutual couplings $S_{21}$, $S_{12}$, $S_{32}$, $S_{23}$, $S_{13}$, and $S_{31}$ of the first through third antenna elements 111, 113, and 115 have a good characteristic of up to −28 dB through −29 dB at the bands of 5.25 GHz and 5.8 GHz.

According to the present invention, mutual interference between the antenna elements is prevented by the isolation element formed between the antenna elements, thereby preventing the distortion of the radiation pattern.

Also, since the isolation element is grounded to the ground surface, the isolation element operates as a parasitic antenna, thereby increasing the output gain.

Further, since the isolation element and the antenna element are formed by etching a metal film layered on a substrate, the manufacturing method is very easy. Also, since the metal film on the substrate forms the isolation element, the antenna can be fabricated in a flat-plate of the closest proximity to a 2-dimensional structure.

Thus, the flat-plate MIMO array antenna according to the present invention can be used in a micro MIMO system.

The foregoing embodiments are merely exemplary and are not to be construed as limiting the present invention. The present invention can be readily applied to other types of apparatuses. Also, the descriptions of the exemplary embodiments of the present invention are intended to be illustrative, and not intended to limit the scope of the claims, as many alternatives, modifications, and variations will be apparent to those skilled in the art.

What is claimed is:

1. A flat-plate Multiple Input and Multiple Output (MIMO) array antenna comprising:

a substrate;

a plurality of antenna elements disposed on the substrate; and at least one isolation element interposed between each antenna element of the plurality of antenna elements and connected to a ground, wherein the at least one isolation element is U-shaped and comprises a first strip, a second strip and a third strip, and each strip is separately disposed on the substrate.

2. The flat-plate MIMO array antenna as claimed in claim 1, wherein the at least one isolation element cancels the effect of an electromagnetic wave radiated from said each antenna element that affects other antenna elements.

3. The flat-plate MIMO array antenna as claimed in claim 1, wherein the isolation element is connected to the ground through a via hole.

4. The flat-plate MIMO array antenna as claimed in claim 1, further comprising a plurality of feed units which feed power to the plurality of the antenna elements.

5. The flat-plate MIMO array antenna as claimed in claim 4, wherein the plurality of the antenna elements includes a first antenna element disposed on the substrate, and a second antenna element spaced apart from the first antenna element.

6. The flat-plate MIMO array antenna as claimed in claim 5, wherein the second antenna element is spaced apart from the first antenna element by a first predetermined distance on the substrate.

7. The flat-plate MIMO array antenna as claimed in claim 6, wherein the isolation element is interposed between the first and second antenna elements.

8. The flat-plate MIMO array antenna as claimed in claim 7, wherein the isolation element is spaced apart from the first and second antenna elements.

9. The flat-plate MIMO array antenna as claimed in claim 8, wherein the isolation element is spaced apart from the first and second antenna elements by a second predetermined distance.

10. The flat-plate MIMO array antenna as claimed in claim 9, wherein the first and second antenna elements are symmetrically disposed with respect to a predetermined virtual line of the substrate.

11. The flat-plate MIMO array antenna as claimed in claim 10, wherein the isolation element is symmetrically disposed with respect to the predetermined virtual line.

12. The flat-plate MIMO array antenna as claimed in claim 11, wherein the isolation element has an inverted U-shape.

13. The flat-plate MIMO array antenna as claimed in claim 12, wherein the isolation element has a length of λ which is a wavelength of a wave radiated from the first and second antenna elements.

14. The flat-plate MIMO array antenna as claimed in claim 13, wherein the first and second antenna elements are spaced apart from each other by a distance of λ/2.

15. The flat-plate MIMO array antenna as claimed in claim 13, wherein the isolation element is spaced apart from the first and second antenna elements by a distance of λ/4.

16. The flat-plate MIMO array antenna as claimed in claim 11, wherein the first and third strips are disposed in parallel with respect to the center line, and the second strip connects one end of the first strip and one end of the third strip.

17. The flat-plate MIMO array antenna as claimed in claim 16, wherein each of the first and second strips has a length of approximately 0.39λ, and the third strip has a length of approximately 0.17λ, wherein λ is a wavelength of a wave radiated from the first and second antenna elements.

18. The flat-plate MIMO array antenna as claimed in claim 16, wherein the isolation element has a width of approximately 0.026λ, wherein λ is a wavelength of a wave radiated from the first and second antenna elements.

19. The flat-plate MIMO array antenna as claimed in claim 4, wherein the feed units are disposed on the substrate and are spaced apart from the plurality of antenna elements at a predetermined distance.

20. The flat-plate MIMO array antenna as claimed in claim 1, wherein the ground is disposed on a side of the substrate opposite to one side of the substrate where the plurality of the antenna elements are disposed.

* * * * *